United States Patent [19]

Deane et al.

[11] 4,429,195

[45] Jan. 31, 1984

[54] TIMING MECHANISM

[75] Inventors: Kenneth E. Deane, Beech Grove; Robert S. Coulter, Plainfield, both of Ind.

[73] Assignee: Emhart Industries, Inc., Indianapolis, Ind.

[21] Appl. No.: 373,519

[22] Filed: Apr. 30, 1982

[51] Int. Cl.[3] ..... H01H 7/00

[52] U.S. Cl. ..... 200/38 A; 200/288

[58] Field of Search ..... 200/38 R, 38 A, 38 F, 200/38 FA, 38 FB, 38 B, 38 BA, 38 C, 38 CA, 38 D, 38 DA, 38 DB, 38 DC, 38 E, 288, 33 R, 33 A, 33 B, 33 C, 33 D, 34, 35 R, 35 H, 35 B, 35 EQ, 35 A, 35 W, 36, 37 R, 37 A, 39 R, 39 A, 153 LB

[56] References Cited

U.S. PATENT DOCUMENTS 1,120,712 12/1914 Hall ..... 200/288

2,782,287 2/1957 Smith ..... 200/153 LB 4,348,560 9/1982 Ray et al. ..... 200/38 A

FOREIGN PATENT DOCUMENTS 2328971 1/1975 Fed. Rep. of Germany ..... 200/288

*Primary Examiner*—E. A. Goldberg

*Assistant Examiner*—Morris Ginsburg

*Attorney, Agent, or Firm*—Robert F. Meyer

[57] ABSTRACT

An improvement is presented for a timing mechanism wherein the closing of a particular circuit results in a high electrical current surge. The rapidity of the circuit closure (made necessary by the current surge) results in contact bounce. A fast drop of a cam follower is provided by a cam having a substantially flat outer periphery and a face which has a steep drop with a gentle curvature. Upon dropping the cam follower, electrical contact arms are engaged which include a coil spring damper to dissipate kinetic energy encountered during contact closure, thereby preventing the contacts from bouncing.

6 Claims, 9 Drawing Figures

TIMING MECHANISM

BACKGROUND OF THE INVENTION

Generally speaking, the present invention relates to an improvement in a timing mechanism wherein a single cam is axially displaced to permit a cam follower to drop from its outer periphery to engage a switch means, the improvement comprising providing a switch means which includes a pair of movable electrical contact blades having electrical contacts thereon, and dampening means associated with one of the electrical contact blades; and further providing a single cam having a face and an outer periphery, contoured such that the outer periphery is substantially flat and its face has a steep drop with a gentle curvature to permit the cam follower to quickly drop yet remain lightly engaged with the face.

Timing mechanisms are extensively used in the appliance industry to control the functions of an appliance in accordance with a predetermined program. For example, they are extensively used in washers, dryers, dishwashers, and microwave ovens. In some of the applications, the need arises for a short pulsing cycle to be operable within or separate from an overall program. In microwave ovens, for example, such a short pulse is sometimes needed to intermittently apply electrical power to its magnetron. When such power is initially applied to the magnetron, a very high current surge is imposed on the circuit. The surge then drops off. Therefore, there is also a need in this application to provide an even shorter pulse whereby current can be initially switched through a current limiting resistor.

In U.S. Pat. No. 4,246,454 there is described a timing mechanism employing an axial movable cam with two cam followers that opens and closes two switches. While the mechanism very admirably satisfies the above-noted needs, it would be far better from an economic viewpoint if the surge problem could be met by using only one switch. In order to use just one switch, one of the main problems that needs to be overcome is that of the closure mechanism causing contact bounce. Contact bounce causes contact deterioration through double arcing as well as "timer hangup". The present invention admirably solves this problem.

OBJECTS OR FEATURES OF THE INVENTION

It is therefore, a feature of the invention to provide a timing mechanism permitting a switch to be closed and handle high electrical current surges without switch contact bounce. Another feature of the invention is the provision of such a timing mechanism wherein a fast, sharp drop of a cam follower is provided to very rapidly close a pair of electrical contacts. Still another feature of the invention is the provisions of such a timing mechanism wherein the fast, sharp drop is provided by a single axially movable cam having a substantially flat outer periphery and a face with a steep drop with a gentle curvature. Yet another feature of the invention is the provision of such a timing mechanism wherein the switch includes a pair of movable electrical contact blades and a means to dampen kinetic energy developed when the cam follower causes the blades to close. Another feature of the invention is to provide such a timing mechanism wherein the dampening means includes a spring, biased against one of the blades. These and other features of the invention will become apparent from the following description taken in conjunction with the accompanying drawings.

DETAILED DESCRIPTION OF THE INVENTION

Figure 1:
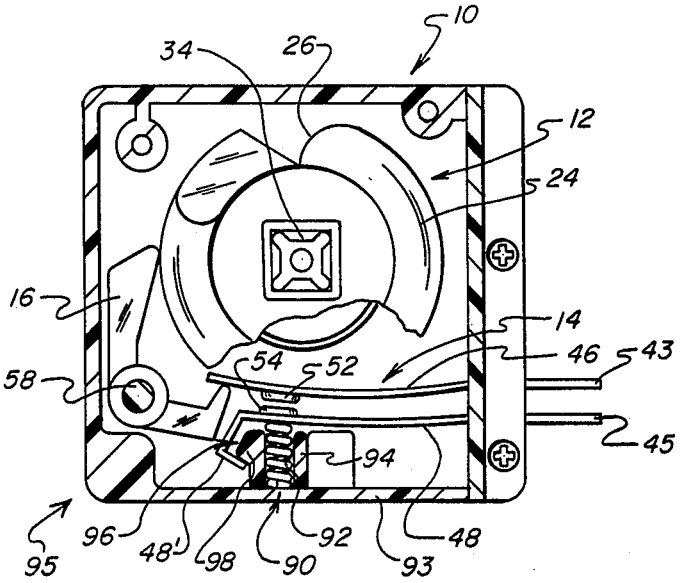
FIG. 1 is a section of the timing mechanism employing the principles of the invention.

Referring to the drawings, there is shown a timing mechanism 10 employing the features of the invention. In general, timing mechanism 10 includes a cam means 12, switch means 14 responsive thereto through a cam follower 16, and motor drive means 20 which applies power driven rotation to the cam means. The motor drive means includes a synchronous motor and a gear train, both of which are well known in the art and, therefore, not completely shown.

Cam means 12 includes a cam 24 having a step 26 in its outer periphery, and a ramp means 28 extending from a face of the cam at the step. The cam is coupled to the gear train of the motor for rotation therewith through coupling means 30. Coupling means 30 also permits the cam to be axially displaced and includes a square aperture 32 provided in the cam and a basically square shaft 34 which mates the aperture. Shaft 34 serves as the output pinion of the gear train of the motor. Its opposed end is journalled for rotation about an end of shaft 36 (end not shown). As will be hereinafter described, cam 24 rotates with shaft 34 and is axially displaceable thereon. The cam is axially spring biased through coil spring 40 which is held between the cam 24 and cavity 41 provided in housing 44 of the timing mechanism. Ramp means 28 includes a V-shaped tab 38, to provide two ramp surfaces.

Switch means 14 (FIG. 1) includes movable electrical contact blades 46 and 48, each integral or otherwise coupled to electrical terminals 43 and 45. Electrical contact blade 46 carries an electrical contact 52 at a distal end thereof, while electrical contact blade 48 carries an electrical contact 54 carried at its distal end. The switch means are opened and closed in accordance with cam follower 16 in a manner hereinafter to be described. Cam follower 16 is pivotally carried on a post 58 to be actuated in accordance with cam 24.

Figure 2:
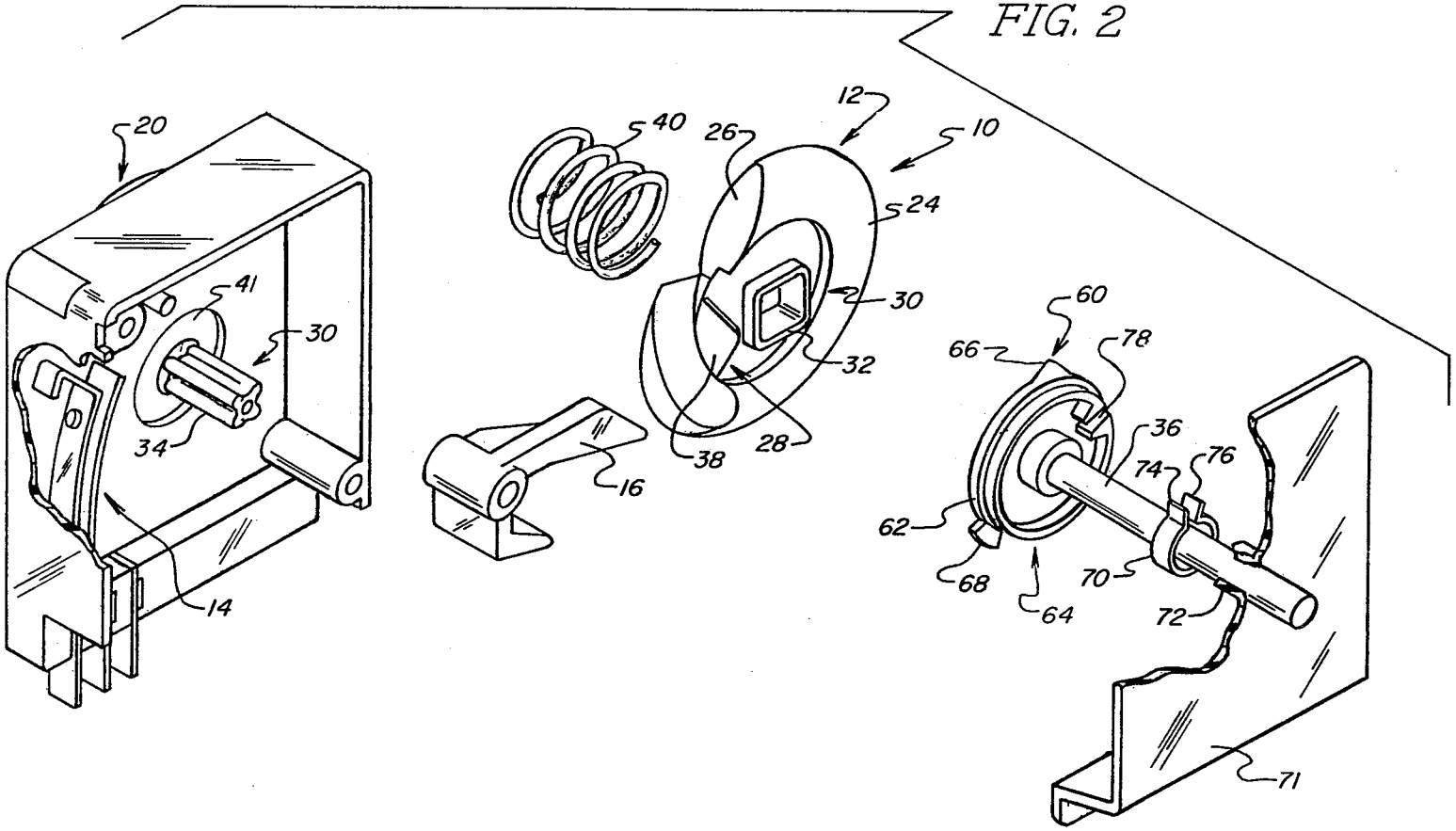
FIG. 2 is an exploded view of the timing mechanism.

Referring to FIG. 2, cam 24 is axially displaced through its ramp means 28 engaging a second ramp means 60 carried by a ring 62 which is fixedly carried on shaft 36. A locator means 64 is integral with ring 62 and is used to locate ramp means 60. Locator means may be manually rotated in either a clockwise or counterclockwise direction. Ramp means 60 includes a V-shaped tab 66 extending from ring 62 and engaging ramp means 28. A clip ring 70 fits around and functionally engages a boss 72 through which shaft 36 rotates. Clip ring 70 includes tangs 74 and 76 extending from opposite ends of the ring. The larger of the tangs 74 engages slot 78 provided in ring 62. The location of ramp means 60 can be manually set by manually rotating shaft 36 to overcome the friction between the clip ring and the boss, with notch 78 engaging the inner or outer face of tang 74 to relieve or increase the pressure. A tab 68 engages a stop means (not shown) carried on end plate 71 to limit the manual rotation.

As will be more fully described with reference to FIGS. 4A–6B, upon power driven rotation of shaft 34, cam 24 will rotate until ramp means 30 engages ramp means 60 to axially index cam 24 to permit cam follower 16 to drop and actuate switch means 14.

Figure 3:
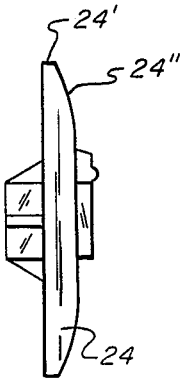
FIG. 3 is a side view of a cam of the timing mechanism.

Referring now to FIG. 3, there is shown a feature of the present invention which permits follower 16 to very quickly drop from cam 24. More particularly, according to a feature of the invention, cam 24 is contoured such that the outer periphery has a substantially flat portion 24' with its face having a steep drop with a gentle curvature 24'' sufficient to permit cam follower 16 to quickly drop yet remaining lightly engaged with the face. Such contour facilitates the needed quick drop while substantially aiding in reducing contact bounce and switch noise.

With reference to FIG. 1, there is shown another feature of the invention which further aids in reducing contact bounce. Such feature includes a dampening means 90 which includes a coil spring 92 carried in a cylindrical receptacle 94 and biased between electrical contact blade 48 and a wall 93 of a housing 95 for the timing mechanism, the cylindrical receptacle extending from the wall. When follower 16 quickly drops from cam 24, electrical contact blade 46 quickly drops to quickly close with electrical contact 54. Coil spring 92 compresses to absorb the kinetic energy generated by the quickly falling electrical blade and electrical contact 52. When cam follower 16 returns to the outer periphery of cam 24, electrical contact blade 46 is moved away from electrical blade 48 to open the electrical contacts. The travel of electrical contact blade 48 is limited upon release through an extension 48' engaging a stop means 96. Stop means 96 includes a protuberant 98 from receptacle 94.

Figure 4A:
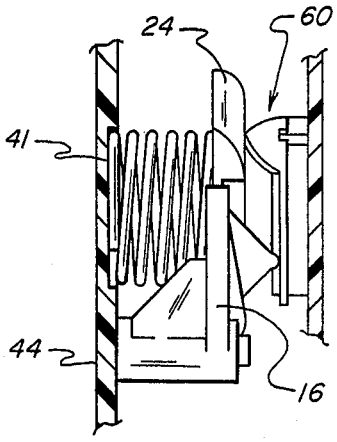
FIGS. 4A through 6B are similar views in partial section showing different operating stages of a cam means of the timing mechanism.
Figure 4B:
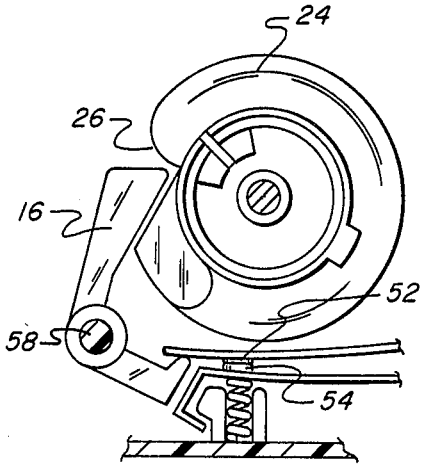
Figure 5A:
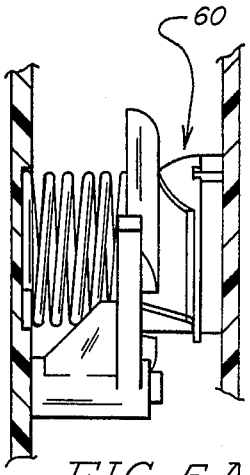
Figure 5B:
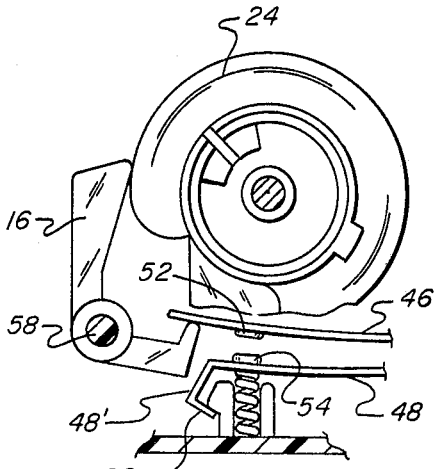
Figure 6A:
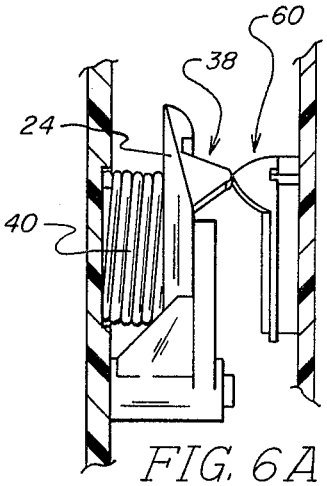
Figure 6B:
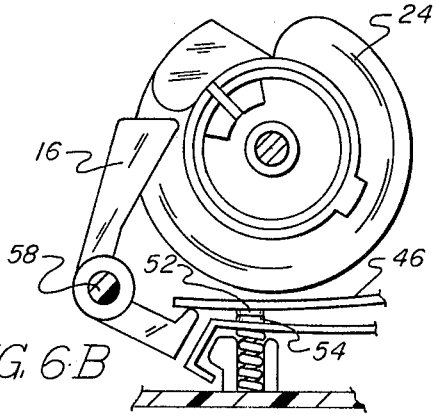

Referring now to FIGS. 4A–6B, the operation of the device can now be described. In FIGS. 4A and 4B, cam 24 is rotating counterclockwise. Cam follower 16 has just entered notch 26, the cam having just completed a cycle. Electrical contacts 52 and 54 are closed. In FIGS. 5A and 5B, cam follower 16 has risen up to the flat outer periphery of cam 24 to pivot follower 16 and opened the electrical contacts 52 and 54. The distance of electrical contact blade 48 has been limited by extension 48' engaging stop means 96. In FIGS. 6A and 6B, ramp means 60 has engaged ramp means 38 to bias cam 24 axially against coil spring 40 to permit cam follower 16 to quickly drop causing it to pivot and permitting electrical contact blade 46 to quickly drop with its electrical contact 52 to close electrical contact 54. The cam is held in this position by cam follower being biased against cam face 24'.

What is claimed is:

1. A timing mechanism comprising:

(a) shaft means, (b) a cam carried on said shaft means and coupling means coupling same to said shaft means for rotation therewith, (c) spring means axially biasing said cam, (d) a cam follower engaging said cam to be sequentially actuated in accordance with an axial displacement of said cam, (e) a switch means responsive to said cam follower comprising a pair of movable electrical contact blades each of said blades including an electrical contact, and (f) a dampening means disposed between and engaging one of said pair of movable electrical contact blades and a fixed member of said timing mechanism.

2. A timing mechanism according to claim 1 wherein said fixed member is a wall of said timing mechanism.

3. A timing mechanism according to claim 2 wherein said dampening means is a coil spring.

4. A timing mechanism according to claim 3 wherein said coil spring is carried in a receptacle extending from said wall.

5. A timing mechanism according to claim 4 wherein one of said pair of movable electrical contact blades includes an extension engaging a stop means to limit its travel.

6. A timing mechanism according to claim 5 wherein said stop means includes a protuberant extending from said receptacle.

* * * * *